United States Patent [19]

Van Camp

[11] Patent Number: 4,629,273

[45] Date of Patent: Dec. 16, 1986

[54] ELECTRICAL CABLE CONNECTOR ASSEMBLY

[76] Inventor: James L. Van Camp, 2490 Manila, Mt. Clemens, Mich. 48045

[21] Appl. No.: 710,370

[22] Filed: Mar. 11, 1985

Related U.S. Application Data

[63] Continuation of Ser. No. 479,138, Mar. 28, 1983, abandoned.

[51] Int. Cl.[4] ..... H01R 4/00

[52] U.S. Cl. ..... 339/94 M; 339/136 M; 339/103 B

[58] Field of Search ..... 339/94, 177, 136, 103; 285/404

[56] References Cited

U.S. PATENT DOCUMENTS

| | | | |
|---|---|---|---|
| 1,930,322 | 10/1933 | Paulson | 339/103 R |
| 3,489,439 | 1/1970 | Word, Jr. | 285/404 |
| 4,124,231 | 11/1978 | Ahlstone | 285/404 |

*Primary Examiner*—Gil Weidenfeld
*Assistant Examiner*—David L. Pirlot
*Attorney, Agent, or Firm*—Lon H. Romanski

[57] ABSTRACT

A cable connector assembly has a body portion having first and second functional ends with first and second openings respectively formed therein, a passage extends through the body portion and terminates at its opposite ends respectively in the first and second openings, an electrical cable extends through the passage and the first and second openings, a first retainer for operatively securing a first portion of the electrical cable passes through the first opening to the first functional end, and a second retainer for operatively securing a second portion of the electrical cable passing through the second opening to the second functional end, the respective axes of the first and second portions of the electrical cable being at an angle with respect to each other of a magnitude generally in the order of 75°.

15 Claims, 12 Drawing Figures

ELECTRICAL CABLE CONNECTOR ASSEMBLY

RELATED APPLICATION

This application is a continuation of application Ser. No. 479,138 filed Mar. 28, 1983 now abandoned.

FIELD OF THE INVENTION

This invention relates generally to electrical connectors and more particularly to electrical connector assemblies employed for electrically connecting an electrical cable to an associated electrical panel or terminal whether fixed or movable.

BACKGROUND OF THE INVENTION

Heretofore the prior art has provided various forms of electrical cable connector assemblies. Such, typically, took the form of a straight connector or a 90° angle connector. Generally, in a straight connector the main body or housing portion of the connector assembly is axially extending, without any bend, and the cable, operatively, extends through the body or housing portion as to terminate in respective electrical pins or sockets which are parallel to the axis of the main body or housing portion. In comparison, in a 90° angle connector, the main body or housing comprises two axial portions which are disposed at 90° relative to each other and which receive the electrical cable therein as to have the terminating electrical pins or sockets parallel to the axis of one of the two housing portions and generally normal to the axis of the other of the two housing portions.

Often such cable assemblies comprise fifty or more individual conductors which, respectively, terminate in fifty or more electrical terminals (pins or sockets). Such cable assemblies are relatively quite heavy and such weight along with other considerations often dictates that the cable assembly connector not be of the straight connector type but rather of an angle type so as to make it easier for connection as to an associated vertically extending electrical panel or the like. The 90° angle connector assemblies of the prior art performed such a function; however, in performing such a function it was found that attendant problems existed at time of connecting such connectors to the associated electrical panel and other problems existed during the manufacture of the 90° angle connector.

The invention as herein disclosed is primarily directed to the problems associated with the 90° angle connectors of the prior art as well as other related and attendant problems

SUMMARY OF THE INVENTION

According to the invention, a cable connector assembly comprises body portion having first and second functional ends with first and second openings respectively formed therein, passage means extending through said body portion and terminating at its opposite ends respectively in said first and second openings, an electrical cable extending through said passage means and said first and second openings, first retainer means for operatively securing a first portion of said electrical cable passing through said first opening to generally said first functional end, and second retainer means for operatively securing a second portion of said electrical cable passing through said second opening to generally said second functional end, the respective axes of said first and second portions of said electrical cable being at an angle with respect to each other of a magnitude generally in the order of 75°.

Various general and specific objects, advantages and aspects of the invention will become apparent when reference is made to the following detailed description considered in conjunction with the accompanying drawngs.

BRIEF DESCRIPTION OF THE DRAWINGS

In the drawings wherein for purposes of clarity certain details and/or elements may be omitted from one or more views.

DETAILED DESCRIPTION OF THE PREFERRED EMBODIMENT

Figure 1:
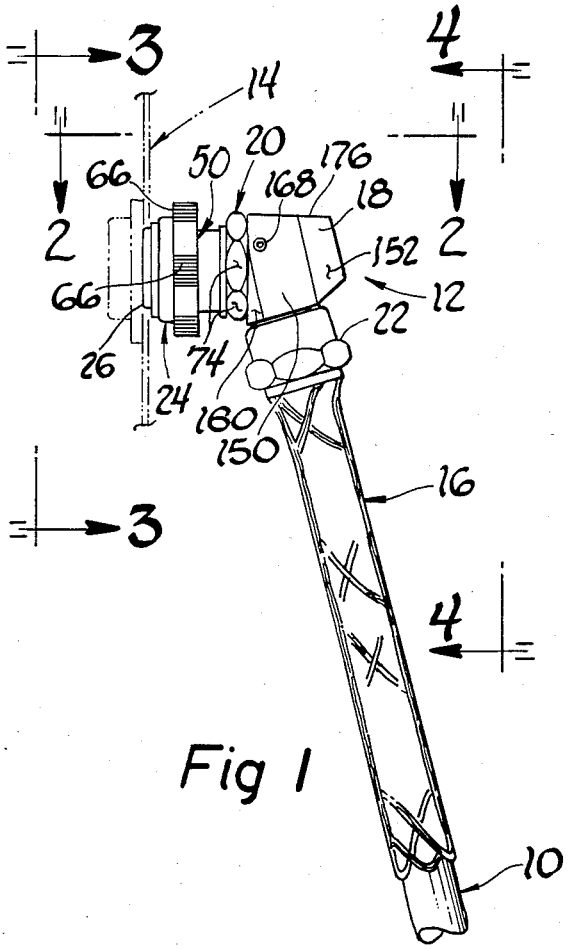
FIG. 1 is a side elevational view of one end of a cable assembly and cable assembly connector, employing teachings of the invention, being depicted as being operatively connected to an associated electrical panel, or the like, illustrated in phantom line.

Referring now in greater detail to the drawings, FIG. 1 illustrates a portion of an electrical cable 10 having an end portion operatively connected to an electrical connector assembly 12, employing teachings of the invention, which, in turn, is depicted as being operatively connected to associated electrical means as, for example, an electrical terminal panel means 14 or the like. Even though not essential to the practice of the invention, a cable gripping and retaining means 16, formed as of stainless steel in a mesh basket weave configuration, may be operatively carried by the connector assembly 12.

As depicted, the connector assembly 12 is illustrated as comprising a body or barrel 18, a body or barrel insert 20 and gland nut 22.

An electrical terminal assembly 24 electrically connected to the cable means 10 is operatively carried as by the insert or adapter 20. In the embodiment illustrated, the terminal assembly 24 is depicted as comprising a generally tubular outer housing or shell-like body 26 which suitably contains and retains dielectric body members or sections 28, 30 and 32. A plurality of socket type electrical terminals, one of which is typically illustrated at 34, are carried as by dielectric body members 28 and 30 and, in turn, respectively electrically connected to the electrical conductors forming the cable means 10 as typically illustrated by conductor 36 which may be provided with an insulating sheath or the like 38. The other conductors are generally depicted as at 40. As is generally well known in the art, the housing or shell-like body 26 may have suitable keying portions 42 and 43 for enabling the connection thereof, only in a predetermined relationship, with the related electrical panel means 14, or the like, at which time the pin-like electrical terminals 44 become in respective operative electrical engagement with socket terminals 34. Somewhat similarly, a key portion 46 may coact as with a portion 48 of dielectric body section 28 to establish and maintain a particular desired angular relationship as between dielectric body means 28 (as well as 30 and 32) and shell-like housing or body means 26.

The connector assembly 24 may also comprise a bayonet type locking ring 50 which is rotatable about the shell-like housing 26. A radiating flange 52, of the shell-like housing 26, coacts with an inner radial shoulder or flange surface 54 of ring 50 to preclude further axial movement of the ring 50 to the right (as viewed in FIG. 5), while a flat-type annular or ring-like compression spring 56, axially contained between flange 52 and a flange 58 carried by ring 50, resiliently permits the limited axial movement of locking ring 50 to the left, as viewed in FIG. 5. The ring 50 may be provided with a plurality of apertures or passages 60, formed as within a barrel portion 62, which may be employed as by cooperating spanner type wrench for assisting the connection or disconnection of the connector assembly 24 as to the associated means 14. The locking ring 50 may also be generally arcuately relieved, peripherally, as generally depicted at 64 of FIGS. 1, 2 and 3, and also have formed thereon, as between such relieved portions 64, seratted-like surface means 66, all of such being directed to assist in the gripping of the locking ring 50 during the manual connection and/or disconnection thereof from associated means, as for example, 14.

Referring again in greater detail to FIG. 5, the shell-like body or housing means 26 is illustrated as being provided with an axially extending externally threaded portion 68 which threadably coacts with an internally threaded portion 70 of annular insert or adapter member 20.

It should be emphasized that the practice of the invention is not limited to whether socket or pin, or female or male type electrical connecting means are employed, or to the particular, if any, dielectric body means 28, 30 and 32 employed, or to the configuration of the shell-like body or housing 26 employed, if any, or the type of latching means 24 employed, if any.

Figure 5:
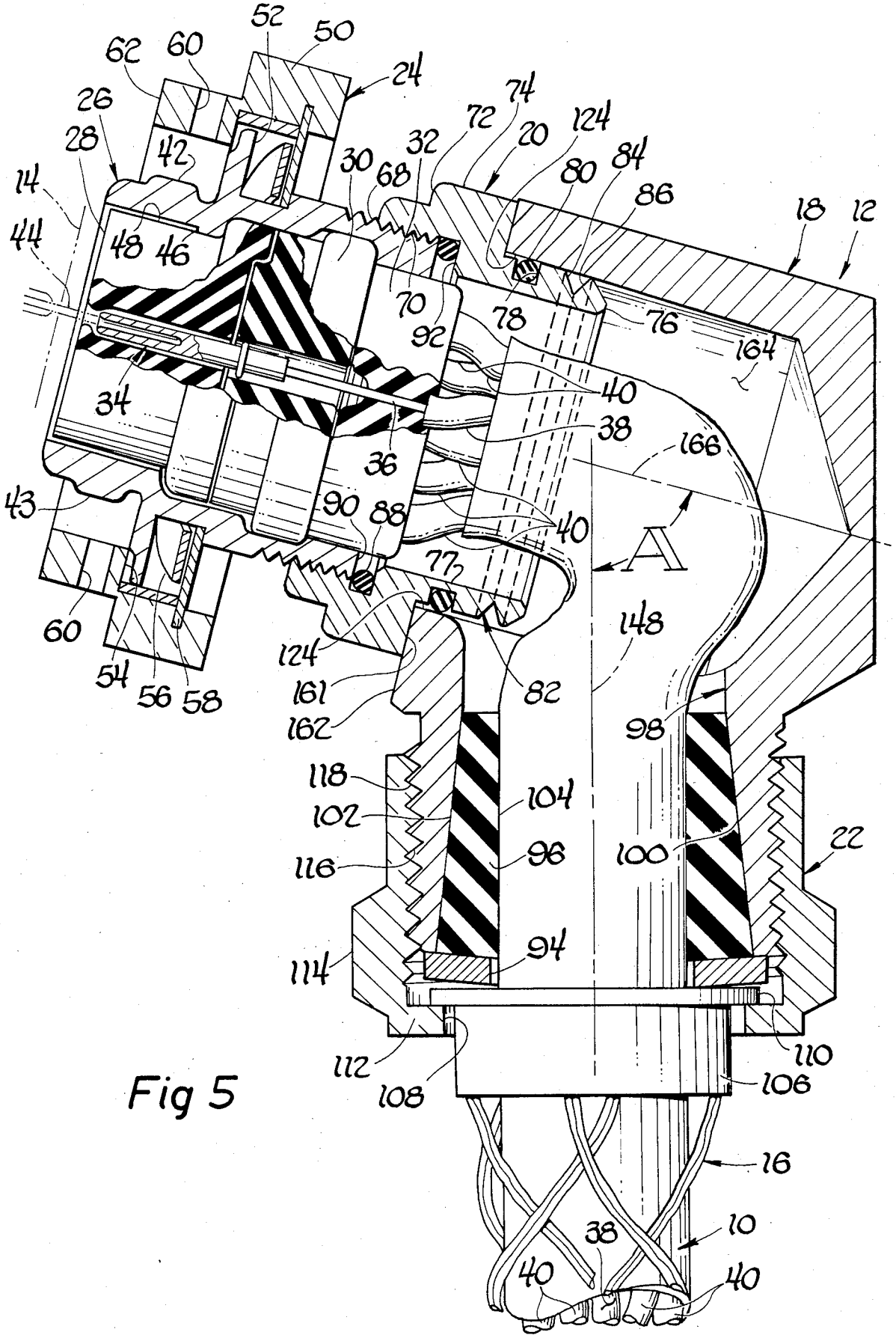
FIG. 5 is a relatively enlarged cross-sectional view, with portions thereof shown in cross-hatching, taken generally on the plane of line 5—5 of FIG. 3 and looking in the direction of the arrows.
Figure 6:
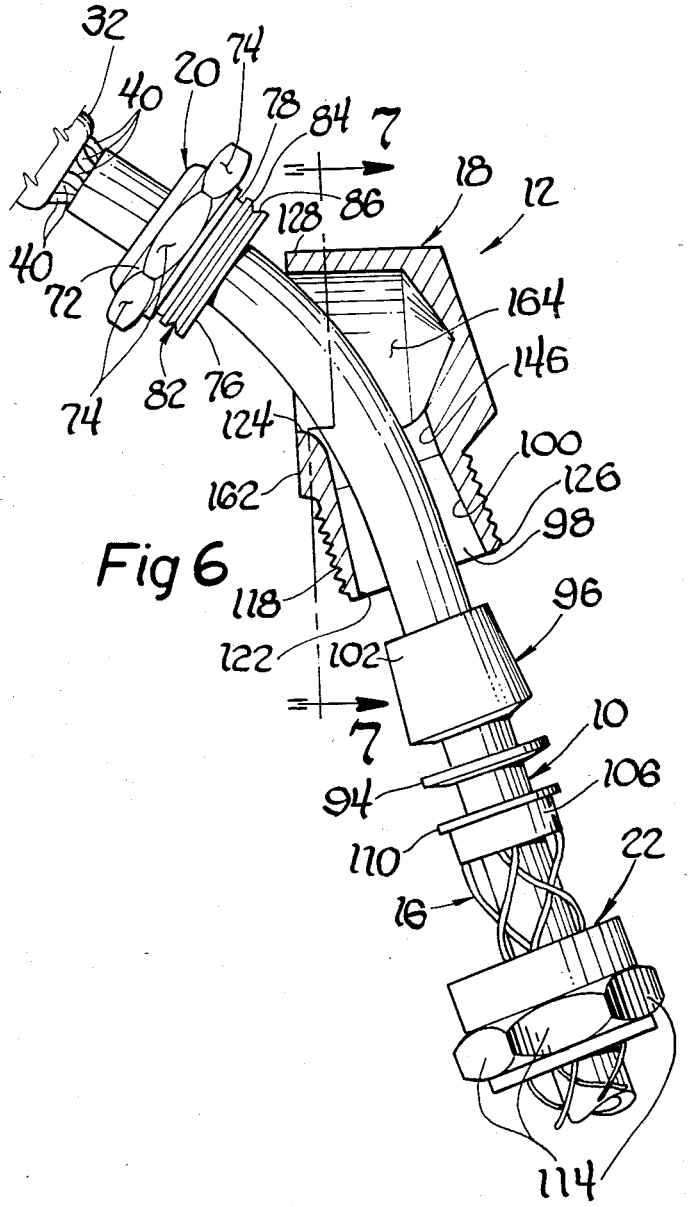
FIG. 6 is a view of most of the elements shown in FIG. 1, but in a somewhat disconnected form, with some of the elements being shown in elevation and other of the elements being shown in axial cross-section.

Referring to FIGS. 5 and 6, in the preferred embodiment, the insert or adapter means 20 comprises a generally tubular member carrying, as an integral part thereof, a relatively radially enlarged body portion 72 which, preferably, is provided with tool engaging surface means 74 which, as depicted, may take the form of a hexagonal nut-like structure.

A tubular extension 76 of adapter means 20 is preferably provided with a first annular groove 78, formed in the outer cylindrical surface, which, in turn, is effective for seatingly receiving an annular seal such as an O-ring 80. A second annular groove 82 is formed in the outer cylindrical surface, of extension 76, as to be axially spaced from groove 78. In the preferred form of annular groove 82, the annular side walls 84 and 86 are inclined toward each other as to generally meet or blend into each other, as at a radially inner portion, defining a generally V-like configuration when viewed, for example, in axial cross-section.

As best seen in FIG. 5, in the preferred arrangement, an annular seal, such as an O-ring 88, is generally axially contained between an axial end surface 90 of shell-like housing 26 and a generally radially inwardly directed flange or shoulder 92 of insert or adapter means 20.

As shown in both FIGS. 5 and 6, in addition to the basketweave retainer means 16, a gland 96 and washer-like member 94 are also carried about the cable means 10. In the preferred arrangement, the housing or body means 18 is provided with a passageway means 98 having at least a portion thereof of a tapered configuration 100. As depicted in FIG. 6, the gland 96, of preferably elastomeric material, in a relaxed or free state, has its outer surface 102 of a configuration at least generally matching the surface of passageway segment or section 100 while its inner generally cylindrical surface 104 closely conforms to the outer surface of the cable means 10.

Referring to both FIGS. 5 and 6, in assembling the sealing gland 96 and cable means 10 to the housing or body 18, the basket or woven portion of retainer means is secured at one end to a collar-like member 106 which passes through an end opening 108 of nut or retainer 22 and which has an outwardly radiating flange portion 110 which, at one axial side abuts against the end wall 112 of nut 22. The other axial side of flange 110 abuts against the washer member 94 which, in turn, axially abuts against the sealing gland 96. The nut 22, preferably provided with tool-engaging surface means 114, has an internally threaded portion 116 which threadably engages an externally threaded portion 118 of housing or body means 18. As the nut 22 is threadably engaged and tightened against threaded portion 118, flange 110 forces washer 94 and gland 96 axially inwardly of passage means 98 generally wedging sealing gland means 96 annularly between the cable assembly 10 and juxtaposed portion of passageway section 100. Not only does the sealing means 96, in such assembled condition (as generally depicted in FIG. 5) provide for positive sealing means as between cable assembly 10 and body or housing means 18, in the area of passageway 98, but such gland or sealing means 96, when thusly assembled, also frictionally engages and prevents any undesired or undue motion of cable means 10 relative to housing means 18 and passageway means 98. Obviously, if a retainer means 16 and end collar-flange 106, 110 were not employed, the end wall 112 would still be effective for forcing the gland means 96 axially into an assembled seated condition.

Generally, passage means 98 may be considered as extending through the body or housing means 18 and comprising what may be considered as first and second end-like openings 122 and 124 respectively formed as in first and second functional ends or end portions 126 and 128 of housing means 18.

Figure 9:
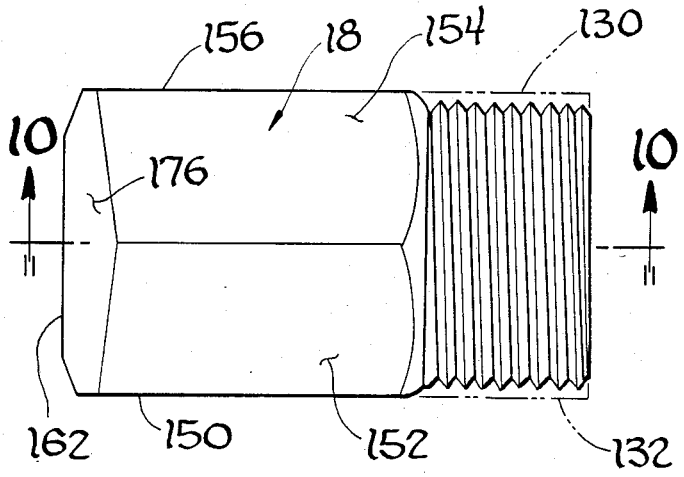
FIG. 9 is a view of one of the elements shown in, for example, FIG. 5 but on a reduced scale.
Figure 10:
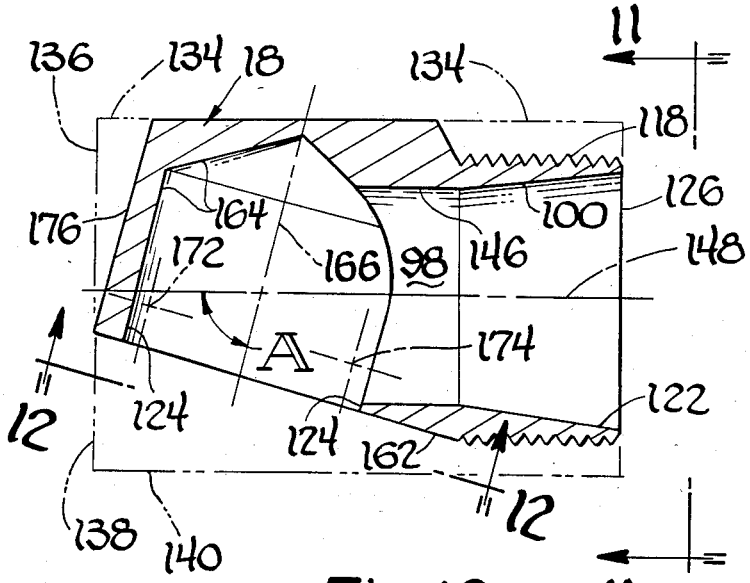
FIG. 10 is a cross-sectional view taken generally on the plane of line 10—10 of FIG. 9 and looking in the direction of the arrows.
Figure 11:
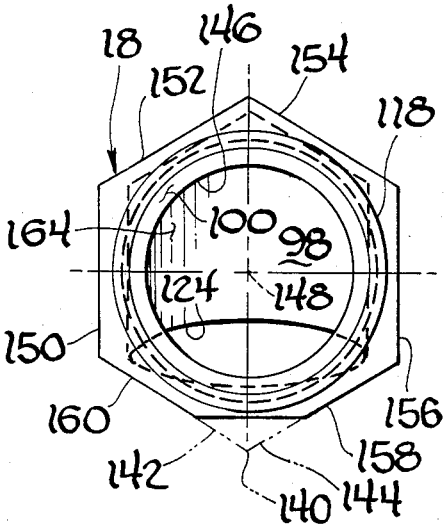
FIG. 11 is an end elevational view taken generally on the plane of line 11—11 of FIG. 10 and looking in the direction of the arrows.
Figure 12:
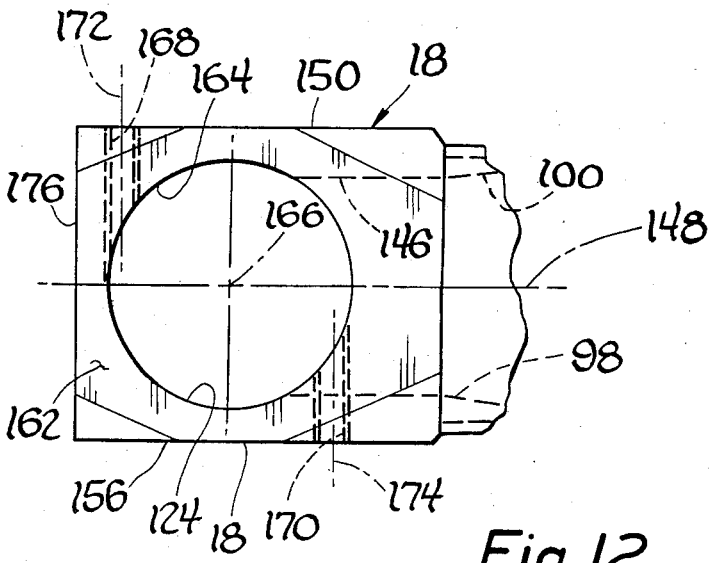
FIG. 12 is a fragmentary view taken generally on the plane of line 12—12 of FIG. 10 and looking in the direction of the arrows.

Referring also to FIGS. 9, 10, 11 and 12, it has been discovered that the housing or body means 18 can be easily formed from standard hexagonal bar stock the boundaries of which are generally depicted by phantom lines: 130 and 132 of FIG. 9; 134, 136, 138 and 140 of FIG. 10 and 142 and 144 of FIG. 11. Although the practice of the invention is not so limited, in the preferred embodiment, the housing or body means 18 would be formed of aluminum.

In the preferred method of manufacturing the housing or body means 18, and not necessarily in precisely the following sequence, passage means 98 may be formed as to define, for example, passageway sections or portions 100 and 146 with portion 146 extending possibly further (than shown) to the left as viewed in FIG. 10. As depicted, the axis 148 of passageway sections or portions 100 and 146, as well as of threaded portion 118, is generally parallel to the sides or side faces 150, 152, 154, 156, 158 and 160 of the hexagonal stock forming the housing or body means 18.

An inclined face 162 is formed, as for example by milling, as to be generally perpendicular to side faces 150 and 156 and inclined to the axis 148 preferably in a magnitude in the order of 15° as viewed in, for example, FIG. 10. The passageway or passage means 98 may be comprised of a third passage portion or section 164, which may be formed as by drilling. Passage section 164 is formed as to have the axis 166 thereof generally; parallel to side faces 150 and 156, perpendicular to inclined face 162 and, preferably, intersecting axis 148. Because of the angle formed by face 162 axis 166 will be inclined with respect to axis 148, as viewed in FIG. 10, in the order of 75° as represented by angle A (and as also depicted by A in FIG. 5). As can be seen in each of FIGS. 10, 11 and 12, passageway section 164 intersects and opens into passage portion 146, thereby completing the passageway or passage means 98, with end opening 124 being effectively formed in or defined by passageway 164.

Preferably, at least two internally threaded passageways 168 and 170 are formed in housing means 18 in a manner as to have such passageways 168 and 170 open into passage means 98. In FIG. 10 the positions of threaded passageways 168 and 170 are represented by respective axes 172 and 174. Although not essential to the practice of the invention, preferably the end axially opposite to end 126 of body 18 is formed, as by milling or the like, to define a planar surface 176 which is generally perpendicular to surfaces or faces 162, 150 and 156.

Figure 2:
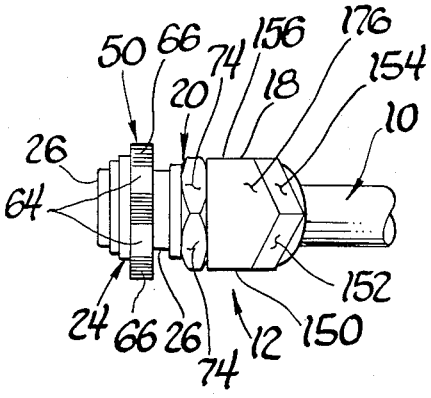
FIG. 2 is a view taken generally on the plane of line 2—2 of FIG. 1 and looking in the direction of the arrows.
Figure 3:
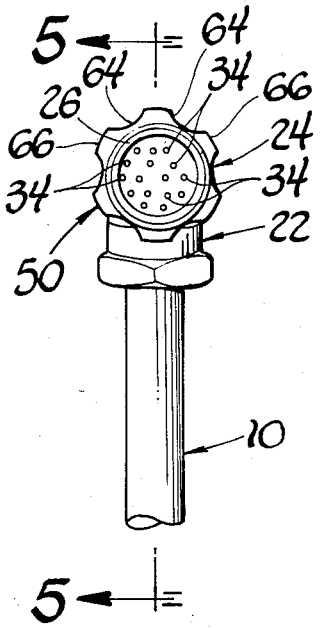
FIG. 3 is a view taken generally on the plane of line 3—3 of FIG. 1 and looking in the direction of the arrows.
Figure 4:
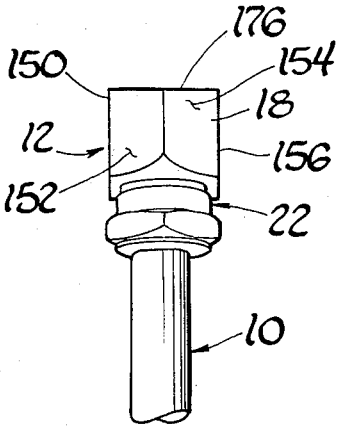
FIG. 4 is a view taken generally on the plane of line 4—4 of FIG. 1 and looking in the direction of the arrows.

It has been discovered that if such hexagonal stock is employed for the forming of body or housing means 18 and if a face 162 is formed at said generally 15° of inclination, the very same stock can be used for forming the insert or adapter means 20 and no machining or fabrication is required to form the flatted outer surfaces 74 or in any way alter or establish the distance as between opposite ones of surfaces 74. That is, when assembled as generally depicted in FIGS. 1, 2 and 3, the resulting locations of flats 74 are sufficiently close, in dimension, to surfaces 176, 150 and 156 of body or housing means 18.

Figure 7:
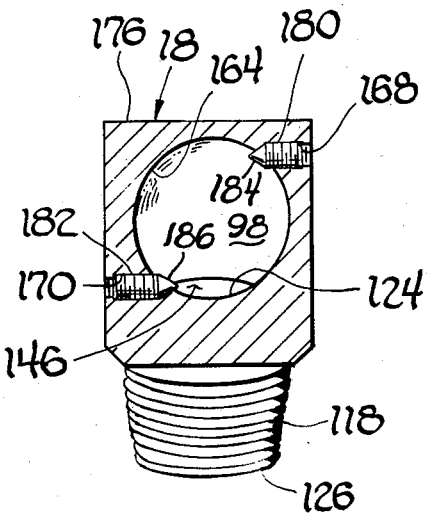
FIG. 7 is a cross-sectional view, taken generally on the plane of line 7—7 of FIG. 6, with certain of the elements not being shown, and looking in the direction of the arrows.

As possibly best depicted by FIGS. 6 and 7, the threaded passages 168 and 170 are respectively provided with, preferably, socket head type set screws 180 and 182 of the type having pointed or cone-like ends 184, 186. In the preferred embodiment, screws 180 and 182 are of the type having a portion thereof resiliently deflectable in order to serve a sealing means for preventing undesired leakage as between coacting threads of the threaded passages 168, 170 and screws 180, 182.

Referring primarily to FIGS. 6 and 5, the invention enables the easier, and therefore more efficient, assembly of the various details and/or elements forming the overall assembly 12. In the commercial production of cable and connector assemblies, it is usually common practice to have the cable means (10) cut to desired length and then operatively secure the selected connector assemblies to the ends thereof. More often than not, the cable means 10 is of a considerably large overall diameter, containing many individual conductors, and somewhat difficult to bend or flex especially when such bending is to be done over a relatively short axial length of the cable means.

In the prior art angle-type connector assemblies, especially the 90° connector assemblies, it was and is absolutely necessary to bend such cable means into a full 90° bend and while holding the cable means in such a configuration, assembling and securing all of the elements and/or details to the end thereof as to form either the male or female terminal thereof. Because of the fact that it is extremely difficult, if not effectively impossible to generally axially move the bent cable assembly within the prior art 90° connector housing, the end of the cable assembly, to be operatively connected to the associated terminal, is usually cut very close to the connector housing so that upon operatively connecting the associated terminal thereto, that portion of the cable assembly can still be forced back into the connector housing. This, of course, requires that only very little space be provided for enabling the person to accomplish the required attachment of the terminal to the end of the cable means. Such limited or cramped space, in turn, often results in problems for the person performing the assembling operations, and, it has been found, often errors in assembly and/or other defects are experienced all of which have to be repaired by subsequent disassembly and re-working.

As best seen in FIG. 6, with the invention it is possible to draw a substantial length of cable assembly or means 10 through passage means 98 of housing 18 because no severe bending of the cable means 10 is required. At this time, the adapter or insert 20 may be placed about the cable means 10 after which connection of the respective conductors, as 40, to and through the body means 32 of the connector portion 24 may be accomplished. After all of such connections are made, the body or shell structure 26 may be secured to the insert or adapter 20 as by threadable engagement of threaded portions 68 and 70 (FIG. 5). It should be pointed out that such a threadable connection of shell 26 and adapter 20 may be accomplished prior to the operative connection between insert 20 and housing or body means 18. Therefore, assuming that to be the case, with sealing means 88 being effectively contained, it becomes possible, and easy, to then connect the insert 20 and connector means 24 to the housing 18 simply by inserting the projecting end 76 into passageway portion 164 until, for example, juxtaposed flange surface 161 and inclined surface 162 operatively abut against each other (FIG. 5). At such time, the annular seal 80 is resiliently deflected by and sealed against the opening 124. The set screws or retainer members 168 and 170 are now generally juxtaposed to the annular groove 82 and the tightening of such screws 168 and 170 cause the ends or points 184 and 186 to be generally received by the annular groove 82 and thereby lock the insert means 20 in assembled condition to housing 18. It should be stressed that such an arrangement enables the shell or body member 26, along with the terminals carried thereby, to be angularly rotated about axis 166 to any desired or selected position and then effectively locked in such position by the tightening of screws or retainer member 168 and 170. This is in contrast to the prior art where once the terminal means are effectively secured to the associated housing it becomes effectively impossible to change the relative position thereof which, in turn, often leads to problems in actual use of the overall assembly especially where the environment is one providing little space for the overall cable assembly.

Further, in the preferred embodiment, the screws or retainers 168 and 170 are so located and the axial location of the annular groove 82 is such, so that when the insert means 20 is operatively received by housing 18 and the screws 168 and 170 are tightened, the ends 184 and 186 of screws 168 and 170 operatively engage inclined annular wall 86 but not annular wall 84. Therefore, as screws 168 and 170 are further tightened, a cam action is achieved as between screws 168, 170 and wall 86 causing the insert 20 to be further forcibly urged to the right (as viewed in FIG. 5) thereby increasing the frictional locking force as between surface 162 and annular flange or shoulder 161.

Figure 8:
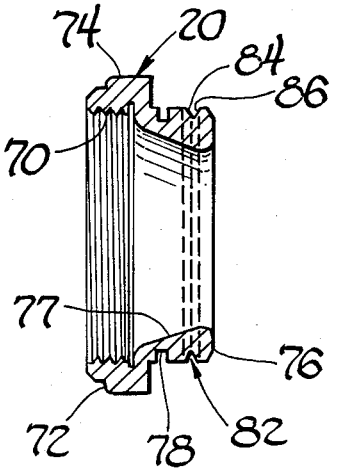
FIG. 8 is an axial cross-sectional view of an element similar to one of the elements shown in FIGS. 1–6 but of a somewhat modified form.

FIG. 8 merely illustrates one of many possible modifications of the insert means 20. In comparing the structure of FIG. 8 to that of FIG. 5 it will be seen that the main difference resides in the inner passage 77 which, in the FIG. 5 embodiment is generally straight cylindrical and in the FIG. 8 embodiment is generally conical.

Although only a preferred embodiment and select modifications of the invention have been disclosed and described, it is apparent that other embodiments and modifications of the invention are possible within the scope of the appended claims.

What is claimed is:

1. A cable connector assembly, comprising a unitary housing body, said housing body comprising a first housing body portion having a first functional end with a first opening formed therein, said housing body comprising a second housing body portion having a second functional end with a second opening formed therein, a passage means extending through said unitary housing body, said passage means comprising first and second passage portions in communication with each other, wherein said first passage portion extends through said first housing body portion as to operatively terminate in said first opening, wherein said second passage portion extends through said second housing body portion as to operatively terminate in said second opening, a continuous electrical cable member free of any discontinuity extending through said first and second passage portions and said first and second openings, said first and second openings being the only openings for said cable to extend therethrough, first retainer means for operatively securing a first portion of said continuous electrical cable member passing through said first opening to generally said first functional end, second retainer means for operatively securing a second portion of said continuous electrical cable member passing through said second opening to generally said second functional end, the respective axes of said first and second passage portions defining an included angle substantially greater than 90° and substantially less than 180°, wherein said second retainer means comprises a generally tubular member, wherein said tubular member is at least partially received within said second opening of said second functional end, wherein said continuous electrical cable member in passing through said second opening passes through said tubular member, and securing means for securing said tubular member to said second housing body portion, said securing means being carried by said second housing body portion in a manner as to be extending in a direction generally transverse to said second passage portion, said securing means also being effective to release said tubular member from said second housing body portion for enabling withdrawal of said tubular member therefrom while said securing means is still being carried by said second housing body portion, wherein said generally tubular member comprises cam surface means, wherein said securing means is effective upon being moved in said direction generally transverse to said second passage portion to operatively engage said cam surface means and urge said generally tubular member in a direction generally axially of said second passage portion as to thereby cause said tubular member to operatively axially abut against said second functional end of said second housing body portion, wherein said cam surface means comprises an annular surface formed in and generally circumscribing said tubular member, wherein said annular surface comprises an annular camming surface portion generally circumscribing said tubular member, wherein said securing means comprises at least one threaded screw member operatively carried by said second housing body portion, wherein said at least one threaded screw member comprises an engagement portion effective to engage said camming surface portion and upon further threadable rotation of said at least one threaded screw member in a direction toward said camming surface portion further urge said tubular member operatively axially against said second functional end of said second housing body portion, and wherein said generally tubular member comprises a first threaded portion effective for connection to a second threaded portion of associated electrical terminal means situated externally of said unitary housing body.

2. A cable connector assembly according to claim 1 wherein a supplementary angle to said included angle added to said included angle equals 180°, and wherein said supplementary angle has a magnitude in the order of 75°.

3. A cable connector assembly according to claim 1 wherein said second functional end lies in a plane, and wherein said plane is at an angle in the order of 15° with respect to the axis of said first passage portion.

4. A cable connector assembly according to claim 1 wherein said tubular member comprises tool-engaging surface means for engagement by associated tool means whereby said tubular member may be rotated as to achieve said connection of said first threaded portion of said tubular member to said second threaded portion.

5. A cable connector assembly according to claim 1 and further comprising sealing means, said sealing means being effective to seal as between said generally tubular member and said second housing portion.

6. A cable connector assembly according to claim 5 wherein said sealing means comprises elastomeric sealing means situated generally about and carried by said tubular member.

7. A cable connector assembly according to claim 5 wherein said sealing means is situated axially generally between said annular camming surface portion generally circumscribing said tubular member and said second functional end.

8. A cable connector assembly according to claim 1 wherein said first retainer means comprises elastomeric means peripherally engaging said continuous electrical cable member and being in turn secured to said first housing body portion.

9. A cable connector assembly according to claim 8 and further comprising an externally threaded portion carried by said first housing body portion, an internally threaded sleeve-like member, said sleeve-like member comprising a generally radially inwardly directed flange portion generally circumscribing said cable member, wherein said first passage portion is formed as to be generally larger in transverse cross-sectional area the closer said first passage portion approaches said first opening, wherein said elastomeric means is situated as to be between said cable member and said first passage portion and in contact with both, and wherein said flange portion operatively urges said elastomeric means generally axially of said cable member and said first passage portion as said sleeve-like member is threadably tightened onto said externally threaded portion thereby resiliently wedging said elastomeric means between said cable member and said first passage portion.

10. An electrical cable connector assembly for use in connecting an electrical cable to associated electrical terminal means, said cable connector assembly comprising a unitary housing body, said unitary housing body comprising a first housing body portion having a first functional end with a first opening formed therein, said unitary housing body comprising a second housing body portion having a second functional end with a second opening formed therein, passage means extending through said unitary housing body, said passage means comprising first and second passage portions in communication with each other, wherein said first passage portion extends through said first housing body portion as to operatively terminate in said first opening, wherein said second passage portion extends through said second housing body portion as to operatively terminate in said second opening, said first and second passage portions being effective to slidably receive therethrough an associated continuous electrical cable member free of any discontinuity whereby said associated electrical cable member is enabled to extend through said first and second openings, first retainer means, said first retainer means comprising a generally tubular elastomeric member of generally tapered configuration receivable in said first passage portion for retaining said associated cable member therein, and second retainer means effective for operatively securing said associated cable member to said second passage portion, the respective axes of said first and second passage portions defining an included angle substantially greater than 90° and substantially less than 180°, wherein said second retainer means comprises a generally tubular member, wherein said tubular member is at least partially received within said second opening of said second functional end, said tubular member being effective to permit the passage therethrough of said associated cable member, said tubular member being capable of selective rotation within said second passage portion about said axis of said second passage portion, said rotation being capable of exceeding 360° in either direction of rotation, and securing means for securing said tubular member to said second housing body portion once said tubular member has been selectively rotated about said axis of said second passage portion, wherein said securing means is carried by said second housing body portion in a manner as to be extending in a direction generally transverse to said second passage portion, said securing means also being effective to release said tubular member from said second housing body portion for enabling withdrawal of said tubular member therefrom while said securing means is still being carried by said second housing body portion, wherein said generally tubular member comprises locking surface means, wherein said securing means is effective upon being moved in said direction generally transverse to said second passage portion to operatively engage said locking surface means and urge said generally tubular member in a direction generally axially of said second passage portion as to thereby cause said tubular member to operatively axially abut against said second functional end of said second housing body portion, wherein said locking surface means is of a continuous generally annular configuration formed in said circumscribing said tubular member, wherein said securing means comprises at least one threaded screw member operatively carried by said second housing body portion, and wherein said at least one threaded screw member comprises an abutment portion effective to engage said locking surface means and upon further threadable rotation of said at least one threaded screw member in a direction toward said locking surface means further urge said tubular member operatively axially against said second functional end of said second housing body portion, said locking surface means by virtue of its said annular configuration circumscribing said tubular member enables said screw member abutment portion to engage said locking surface means regardless of the number of degrees to which said tubular member has been selectively rotated within said second passage portion about said axis of said second passage portion, and wherein said generally tubular member comprises a first threaded portion effective for connection to a second threaded portion of associated electrical terminal means situated externally of said unitary housing body.

11. An electrical cable connector assembly according to claim 10 wherein a supplementary angle to said included angle added to said included angle equals 180°, and wherein said supplementary angle has a magnitude in the order of 75°.

12. An electrical cable connector assembly according to claim 10 wherein said tubular member comprises tool-engaging surface means for engagement by associated tool means whereby said tubular member may be rotated as to achieve said connection of said first threaded portion of said tubular member to said second threaded portion.

13. An electrical cable connector assembly according to claim 10 and further comprising sealing means, said sealing means being effective to seal as between said generally tubular member and said second housing body portion.

14. An electrical cable connector assembly according to claim 13 wherein said sealing means comprises elastomeric sealing means situated generally about and carried by said tubular member.

15. An electrical cable connector assembly according to claim 13 wherein said sealing means is situated axially generally between said locking surface means and said second functional end.

* * * * *